United States Patent [19]

Vitola

[11] 4,366,459

[45] Dec. 28, 1982

[54] MINIATURE MAGNETIC LATCH RELAY

[75] Inventor: Jack J. Vitola, Simsbury, Conn.

[73] Assignee: Hi-G Incorporated, Windsor Locks, Conn.

[21] Appl. No.: 281,652

[22] Filed: Jul. 9, 1981

[51] Int. Cl.[3] ..... H01H 51/22

[52] U.S. Cl. ..... 335/79; 335/128; 335/203; 335/179

[58] Field of Search ..... 335/78, 79, 80, 81, 335/84, 85, 125, 128, 202, 203, 157, 193, 177, 178, 179, 180, 181, 182, 183

[56] References Cited

U.S. PATENT DOCUMENTS

| | | | |
|---|---|---|---|
| 2,955,174 | 10/1960 | Richert | 335/80 |
| 3,001,049 | 9/1961 | Didier | 335/181 |
| 4,101,855 | 7/1978 | Drapeau | 335/203 |

*Primary Examiner*—Harold Broome

*Attorney, Agent, or Firm*—Hayes & Reinsmith

[57] ABSTRACT

A miniature magnetic latch relay including a support header, a permanent magnet, an armature in pivotal contact with the magnet and engaging a pair of switch contacts movable between corresponding pairs of fixed contacts, the armature being pivotally movable between two stable positions in response to selective energization of two electromagnetic coils, and a frame mounted in spaced relation to the header having magnetic core sections for the coils and pole piece sections for the armature, the frame supporting the permanent magnet and having an opening through which the magnet extends for pivotal contact with the armature. A barrier of non-magnetic material in the frame around the opening resists magnetic flux flow between the permanent magnet and the frame portion near the opening thereby forcing magnetic flux to flow between the permanent magnet and the armature. A formation on the end of the magnet is pivotally received in a groove in the armature and is retained therein under vibratory and shock load conditions by a retention tab and pin arrangement carried by the frame and spaced from the armature, the pin to armature spacing being less than the depth of the groove. The formation on the end of the permanent magnet is shaped to enhance flux coupling to the armature.

26 Claims, 10 Drawing Figures

1
118
116
88
52
50
54
92
80
82
18
144
86
4
100
122
96
98
68
70
90
120
62
60
64
84
94
134
20
12
22
14
13

122
96
98
102
104
100
140
134
126
142
144
82

88
92
110
90
80
102
108
96
112
87
104
84
94
98
100

MINIATURE MAGNETIC LATCH RELAY

BACKGROUND OF THE INVENTION

This invention relates to a relay structure, and more particularly to an improved miniature magnetic latch relay of simplified construction.

Permanent magnet latching relays, which employ a permanent magnet to provide a latching function in both of two alternate contact positions, have been used in various configurations and more recently in microminiature size. A problem experienced with permanent magnet latching relays, and especially those relays of microminiature size, is the intricate and costly assembly of numerous parts requiring precise alignment and fastening techniques. There is significant need in the electronics industry for this type of relay in a number of important uses and applications, with the requirements of low cost and reliable operation. Accordingly, it would be highly desirable to provide a compact, microminiature permanent magnet latching relay having substantially fewer parts thereby significantly simplifying mechanical assembly resulting in lower manufacturing costs and high reliability.

SUMMARY OF THE INVENTION

The principal object of this invention is to provide an improved miniature magnetic latch relay.

It is a further object of this invention to provide an improved miniature magnetic latch relay having a simplified construction which is relatively easy to assemble and is low in cost.

It is a further object of this invention to provide an improved miniature magnetic latch relay having improved operating efficiencies and which is reliable in operation.

It is a further object of this invention to provide an improved miniature magnetic latch relay having increased resistance to vibratory and shock load conditions.

The present invention provides a miniature magnetic latch relay including a support header, a permanent magnet, an armature in pivotal contact with the magnet and operatively associated with at least one switch contact movable between two fixed contacts for pivotal movement between two stable positions in response to selective energization of two electromagnetic coils, and a frame mounted in spaced relation to the header having magnetic sections providing cores for the coils and pole pieces for the armature, and the frame supporting the permanent magnet and having an opening therein through which the magnet extends for pivotal contact with the armature located between the frame and the header. A barrier is provided in the frame, for example of non-magnetic material, between the opening and the core and pole piece sections which barrier has sufficient reluctance to resist the flow of magnetic flux between the permanent magnet and the region of the frame near the opening thereby forcing magnetic flux to flow between the permanent magnet and the armature. The permanent magnet has a pivot edge formation on the end thereof which is received in a groove in the armature for pivotal movement, and the frame carries armature retention means which extend in closely spaced relation to the surface of the armature facing the header for retaining the pivot edge formation of the magnet in the groove under vibratory and shock load conditions, the spacing between the armature retention means and the armature surface being less than the depth of the armature groove. The length of the armature groove is less than the armature width thereby restraining relative lateral movement between the armature and permanent magnet. The pivot edge formation on the end of the permanent magnet is shaped to improve the coupling of magnetic flux from the permanent magnet to the armature.

This invention accordingly consists in the features of construction, combination of elements and arrangement of parts which will be exemplified in the construction hereafter set forth and the scope of the application which will be indicated in the appended claims.

BRIEF DESCRIPTION OF THE DRAWING FIGURES

DETAILED DESCRIPTION OF THE ILLUSTRATED EMBODIMENTS

Figure 1:
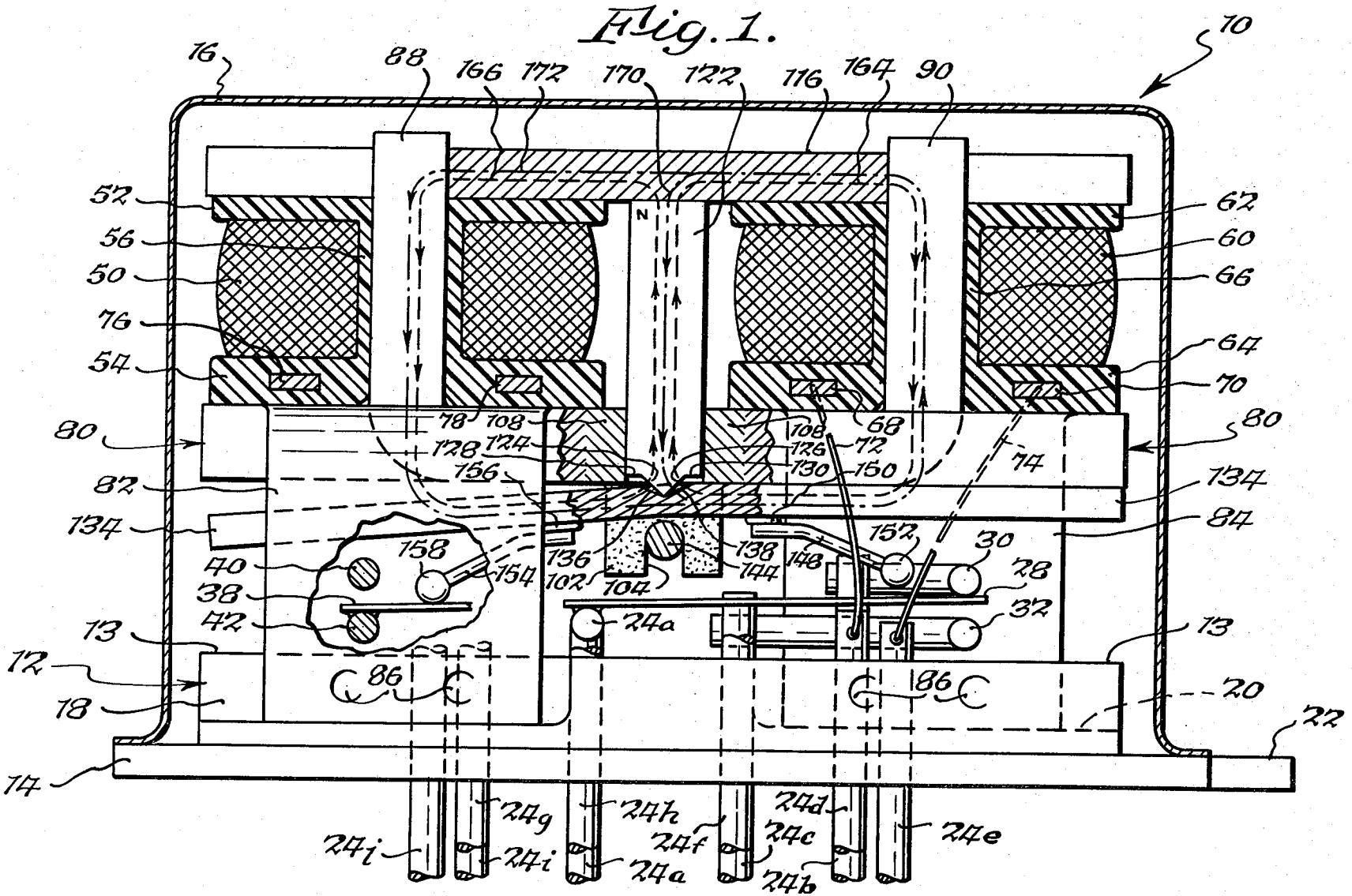
FIG. 1 is a sectional view with parts shown in elevation of a minature magnetic latch relay according to the present invention and taken along lines 1—1 in FIG. 2.

In basic miniature magnetic latch relay structures, an armature is in pivotal contact with a permanent magnet having a pivot edge formation on one end, and the armature and permanent magnet are carried by a support header which includes current-carrying terminal pins extending therethrough, at least one pair of fixed contacts electrically coupled to corresponding ones of the terminal pins, and a movable contact electrically coupled to another one of the pins, in operative association with the armature, normally engaging one of the fixed contacts, and adapted for movement into engagement with the other of the fixed contacts in response to pivotal movement of the armature. The armature is held in either of two stable positions by flux from the permanent magnet thereby placing the movable contact in engagement with one of the fixed contacts. The armature is pivoted to the other of the stable positions by selective energization of a pair of electromagnetic coils carried by the header thereby placing the movable contact in engagement with the other of the fixed contacts.

In accordance with the present invention, a frame is provided having a main body portion spaced from the header and in close relation to the armature, a pair of spaced-apart pole piece sections of magnetic material in the main body portion and operatively associated with the armature, a pair of spaced-apart supporting legs extending from the main body portion toward the header and fixed to the header, a pair of core sections of magnetic material extending from the main body portion in a direction away from the header through the coils and fixed to a yoke of magnetic material spaced from the main body portion and fixed to the other end of the permanent magnet, an opening in the main body portion through which the one end of the permanent magnet extends for pivotal contact with the armature, and a barrier of non-magnetic material in the main body portion surrounding the opening. The barrier has sufficient reluctance to resist the flow of magnetic flux between the permanent magnet and the main body portion thereby forcing magnetic flux to flow between the permanent magnet and the armature. The armature has a groove in the surface facing the permanent magnet for receiving the pivot edge formation of the magnet in a manner allowing pivotal movement. The main body portion of the frame is provided with armature retention means in the form of a pair of tabs extending from opposite sides of the frame and either a single pin fixed to both tabs or a pair of pins fixed to corresponding ones of the tabs, the single pin or pair of pins extending in closely spaced relation to the surface of the armature facing the header. The armature retention means retains the pivot edge formation of the permanent magnet in the armature groove under vibratory and shock load conditions by virtue of the pin to armature surface spacing being less than the depth of the armature groove. The length of the armature groove is less than the width of the armature thereby restraining relative lateral movement between the armature and permanent magnet. The pivot edge formation on the end of the permanent magnet is provided by a pair of surfaces disposed at acute angles to the magnet longitudinal axis and meeting to define the pivot edge, and these surfaces meet a corresponding pair of surfaces extending outwardly therefrom in a direction substantially perpendicular to the magnet longitudinal axis thereby enhancing the coupling of magnetic flux from the permanent magnet to the armature.

Referring to the drawings, the miniature magnetic latch relay 10 comprises several principal assemblies or elements including a motor assembly which comprises a pair of coils carried by the magnetic portion of a frame, an armature assembly, a permanent magnet assembly, and a header assembly which contains switch contact elements and terminal pins on a supporting base.

In the relay shown, the header 12 is formed of metal having a platform surface 13 of generally rectangular configuration with the header serving as a supporting base for the components. A peripheral flange 14 cooperates with the lower flange portion of a casing or cover 16 which is suitably attached to the header as by soldering or welding after assembly of the components thereby hermetically sealing the relay structure. Opposite portions of the peripheral surface of header 12 are provided with laterally off-set recesses or cut-outs 18,20 which define in the relay shown both a step and a right angle shoulder to facilitate mounting of other components of the relay structure on header 12. A guide tab 22 extends laterally from one end of the peripheral flange portion 14 and serves as a reference indicator for plug mounting or wiring of the relay in a known manner. A plurality of current carrying terminal pins 24 project through apertures provided in header 12 and are secured by fused glass (not shown) which also provides both electrical insulation and a fluid-tight seal between header 12 and each pin 24.

The contact assembly includes a first movable contact member or switch blade 28 carried by header 12 and electrically coupled to one of the terminal pins **24*a*. As shown in FIG. 1, terminal pin 24*a* is generally L-shaped having a first portion extending through header 12 generally normal to the plane of surface 13 and a second portion extending generally parallel to surface 13 and spaced therefrom. Switch blade 28, which is in the form of a thin metal strip, is welded at one end to the horizontal portion of pin 24*a* as viewed in FIG. 1 and extends at about a right angle to that portion and in a direction generally parallel to header surface 13. The opposite or free end of switch blade 28 terminates within the periphery of header surface 13 and is movable between a pair of fixed or stationary contact members 30 and 32 each electrically coupled to pins 24*b* and 24*c*, respectively. In particular, contact members 30, 32 are in the form of short, substantially L-shaped wire segments, for example silver wire, each having a diameter substantially equal to that of each terminal pin and each contact member 30,32 being joined as by welding to a corresponding terminal pin adjacent the end thereof. Thus, fixed contact 30 is disposed in a plane substantially parallel to the surface 13, has a first portion extending from terminal pin 24*b* in a direction substantially parallel to the plane of the paper as viewed in FIG. 1, and has a second portion extending at a right angle thereto, i.e. perpendicular to the plane of the paper as viewed in FIG. 1. Contact 32 is located between contact 30 and surface 13, is disposed in a plane substantially parallel to surface 13, as a first portion extending from terminal pin 24*c* in a direction substantially parallel to the plane of the paper as viewed in FIG. 1, and has a second portion extending at a right angle thereto, i.e. perpendicular to the plane of the paper. In addition, contacts 30,32** are positioned in the relay shown such that the first portions are offset horizontally and the second portions are substantially in horizontal alignment.

The assembly of movable contact 28 and fixed contacts 30,32 is located within substantially one half of the header surface 13. The relay structure shown includes a similar assembly on the second half of the header surface 13 including a second movable contact member or switch blade 38 welded at one end (not shown) to a portion of terminal pin **24*f*. Pin 24*f* is similar to pin 24*a* and includes a first portion substantially perpendicular to surface 13 and a second portion disposed substantially parallel to surface 13 spaced therefrom and on which the end of contact 38 is welded. The free end of contact 38 is movable between another pair of fixed or stationary contact members 40,42. The latter are in the form of substantially L-shaped wire segments, for example silver wire, welded to corresponding terminal pins 24*g* and 24*h*, respectively. Contacts 40,42 are located and arranged relative to surface 13 and to each other in a manner similar to that of contacts 30,32**.

The motor assembly includes a pair of coils supported in spaced relation to header 12 and to the contact assembly. A first wire coil 50 is wound on a bobbin of insulative material, for example Nylon, which includes spaced-apart end flanges 52,54 joined by a core section 56 as shown in FIG. 1. In the relay structure shown, the ends 52,54 are of generally rectangular configuration and core 56 defines a rectangular opening extending along the longitudinal axis of the coil. A second wire coil 60 is wound on a bobbin of insulative material for example Nylon, which includes spaced-apart end flanges 62,64 of generally rectangular configuration joined by a core section 66 which defines a rectangular opening extending along the longitudinal axis of the coil. The coils are placed in the relay structure with the longitudinal axis of each coil substantially perpendicular to the header surface 13 and with the end flanges of one coil being in substantially the same planes as the corresponding end flanges of the other coil. In the relay structure shown, the end flanges 54 and 64 which are located closest to header 12 are of relatively greater thickness for accommodating electrical terminals. In particular, a pair of lead-type terminals 68,70 are molded into coil flange 64 and are in spaced-apart, generally parallel relation. Terminals 68 and 70 are connected by leads 72 and 74, respectively to terminal pins 24*d* and 24*e*, respectively, for supplying electrical power to coil 60. Similarly, a pair of lead-type terminals 76,78 are molded in coil flange 54 and are connected by leads (not shown) to terminal pins 24*a* and 24*j*.

Figure 2:
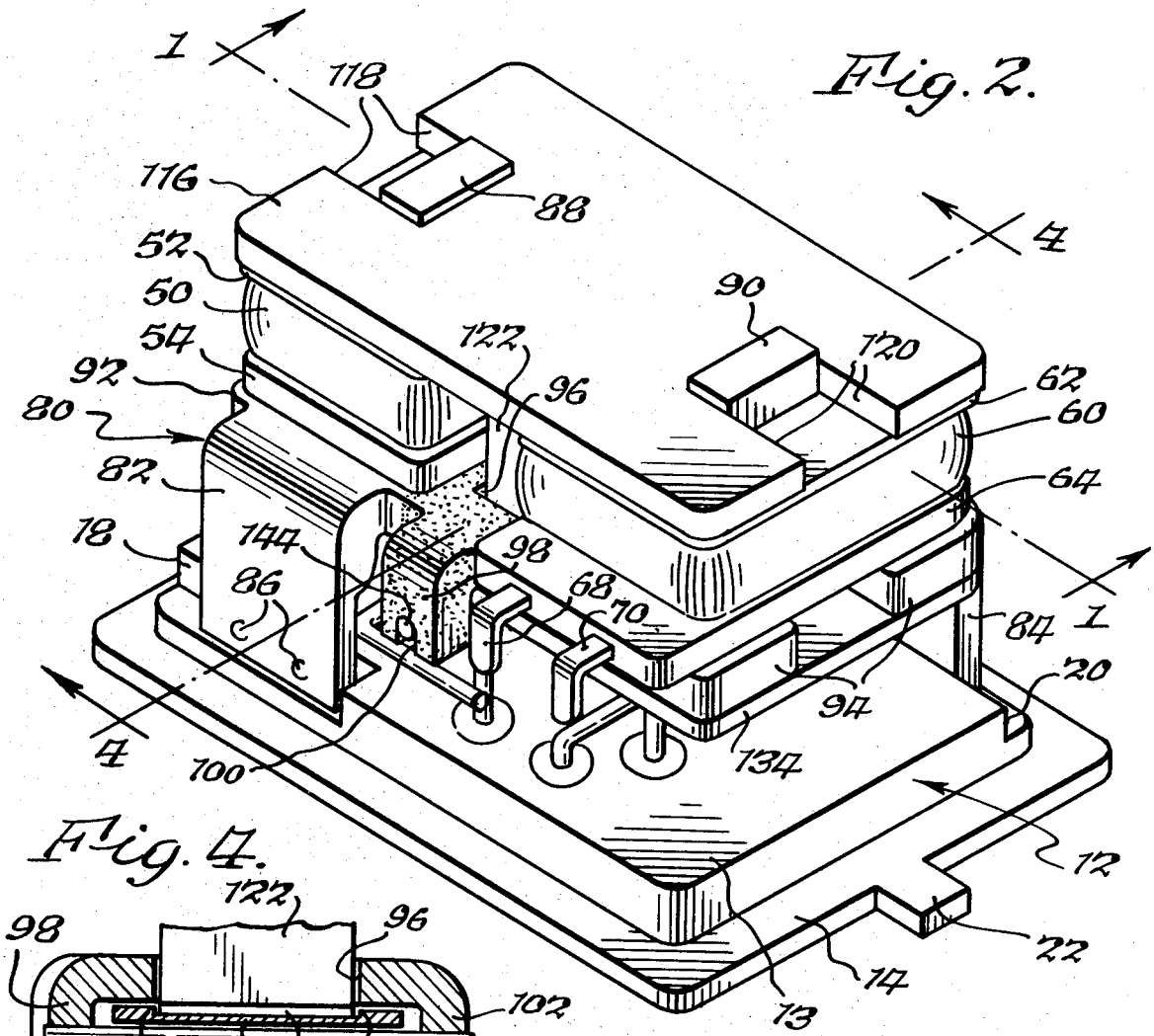
FIG. 2 is a perspective view with parts removed of the miniature magnetic latch relay according to the present invention.
Figure 3:
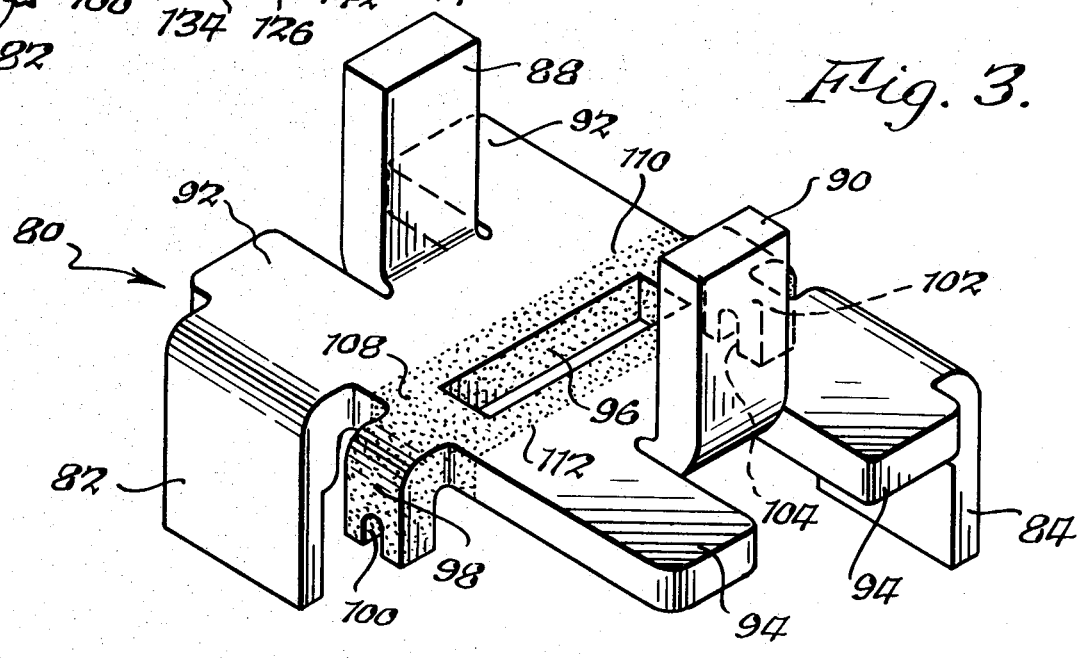
FIG. 3 is a perspective view of the frame included in the relay of FIGS. 1 and 2.

A frame 80, shown also in FIGS. 2 and 3, includes a main body portion of plate-like shape and generally rectangular configuration which is disposed in a plane substantially parallel to header surface 13. The frame main body portion is held in spaced relation to header 12 by a pair of supporting legs 82,84 extending in a direction toward header 12 from opposite side edges of the frame body portion and received in the header recesses 18 and 20, respectively. Legs 82,84 are of substantially the same length and are fixed to header 12 by welds 86. In the relay structure shown, legs 82,84 are disposed generally parallel to each other and substantially at right angles to the frame main body portion. Frame 80 further comprises a pair of core sections 88 and 90 of magnetic material extending from opposite ends of the frame body portion and in a direction away from header 12, i.e. opposite the direction of legs 82,84. Each core section or portion 88,90 extends axially through a corresponding one of the coils and terminates beyond the outer flanges 52,54. In the relay structure shown, core sections 88,90 are of substantially the same length and size and are disposed generally parallel to each other and substantially at right angles to the frame main body portion. As shown in further detail in FIG. 3, frame 80 includes a pole piece section 92 of magnetic material in the end region of the frame body portion including core section 88 and another pole piece section 94 in the end region of the frame body portion including core section 90. Frame 80 is provided with an opening 96 extending through the main body portion in and located generally mid-way between the ends of the body portion. In the relay shown, opening 96 is rectangular, having a length several times greater than the width thereof, and extends lengthwise in a direction substantially parallel to the ends of the frame body portion containing the pole piece sections. Opening 96 receives the end of the permanent magnet which contacts the relay armature in a manner which will be described, and accordingly the shape and size of opening 96 can vary depending upon the cross-sectional shape and size of the permanent magnet. As shown in FIG. 3, frame 80 also includes a first armature retention tab 98 extending from the edge region of the main body portion which includes leg 82 and which tab 98 is provided with a slot 100. Similarly, a second armature retention tab 102 extends from the opposite edge of the frame body, is in lateral alignment with tab 98, and is provided with a slot 102 in alignment with slot 100.

In accordance with the present invention there is provided in the main body portion of frame 80 a barrier 108 associated with opening 96 of a material having sufficient reluctance to resist the flow of magnetic flux between the permanent magnet and the frame body portion thereby forcing flux between the permanent magnet and the relay armature positioned closely adjacent to frame 80. The barrier 108 is a region of non-magnetic material which meets the magnetic material of the remainder of the frame at edges or borders 110 and 112. Thus, barrier 108 is located between opening 96 and the core 88 and pole piece sections 92 at one end of the frame body portion and between opening 96 and the core 90 and pole section sections 94 at the opposite end of the frame body. In the relay structure shown, barrier 108 completely surrounds opening 96. In an illustrative method of making frame 80 a strip of non-magnetic material, for example stainless steel, is positioned between two strips of magnetic material, such as iron. The center and side strips are bonded together along the abutting edges, preferably by electron beam welding, to create a composite strip. Both the magnetic and non-magnetic strip material should be of the same thickness to generate good welds. The camber and edge conditions of the materials should be controlled, and the materials must be compatible for welding. After the welding operation, the composite strip is shaped to specific flatness, usually by cold rolling to provide a flush straight piece of material stock. Finally, the composite strip material is fabricated by several punching and stamping operations into a flat outline of the desired frame whereupon the supporting leg portions and core portions are bent to the respective positions shown in FIG. 3. Thus, in a frame 80 made according to the foregoing illustrative method, barrier region 108 is of stainless steel and the remainder of frame 80 is of iron.

The permanent magnet assembly includes a yoke 116 in the form of a planar, rectangular element of magnetic material such as iron which is carried by frame 80 adjacent coils 50,60. Yoke 116 is provided with rectangular-shaped cutouts 118 and 120 at opposite ends thereof into which the outer ends of the cores 88 and 90, respectively, are received and fixed such as by welding. In the relay shown, the planar end faces of cores 88,90 extend a slight distance beyond the outer surface of yoke 116. A permanent magnet 122 of generally rectangular shape is fixed such as by welding at one end thereof to the central portion of yoke 116 and extends in a direction normal to yoke 116 and between coils 50 and 60 and through opening 96 in frame 80 whereupon it terminates in an end formation defining a fulcrum or pivot edge for the armature. In particular, magnet 122 has a longitudinal axis disposed generally perpendicular to the body portion of frame 80 and to the header surface 13. The fulcrum or pivot edge is defined by a pair of surfaces 124 and 126 each disposed at an acute angle to the longitudinal axis of magnet 122 and meeting to define the fulcrum or pivot edge. By way of example, each surface 124,126 defines an included angle of 30° with the magnet longitudinal axis. The angularly disposed surfaces 124 and 126 meet a pair of surfaces 128 and 130, respectively, disposed substantially perpendicular to the magnet longitudinal axis. The formation at the end of magnet 122 including the edge-defining surfaces 124,126 disposed at acute angles to the magnet longitudinal axis and the additional surface 128,130 disposed normal to the magnet axis provide an improved coupling of magnetic flux from magnet 122 to the relay armature. By way of example, magnet 122 can be of cast Alnico 5–7 material. Magnet 22 can fit tightly within opening 96 or even be attached to the surface of opening 96 for increased support. Alternatively, there can be a slight clearance between magnet 22 and opening 96 to permit adjustment and positioning of magnet 122 relative to co-operating structures such as the armature.

Figure 4:
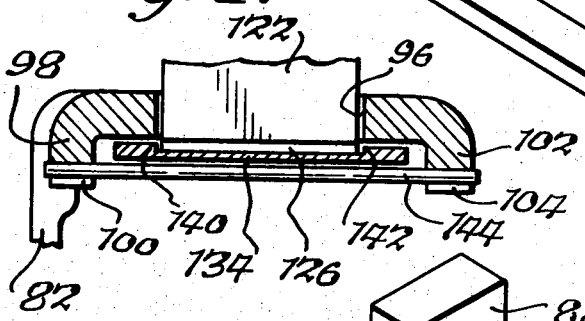
FIG. 4 is a fragmentary sectional view taken along lines 4—4 in FIG. 2.

An armature 134 of ferromagnetic material is located in spaced relation to header 12 and closely adjacent the body portion of frame 80. The armature is in the form of a plate-like body having a generally rectangular configuration. Armature 134 has an axis of rotation or pivot axis normal to the longitudinal axis thereof and located substantially mid-way between the ends thereof. Armature 134 is bent or otherwise formed along the pivot axis to define two slightly angularly disposed halves. In other words, armature 134 is shaped as shown in FIG. 1 so that when one half portion contacts one of the pole pieces, the other armature half portion is spaced a small distance from the other pole piece to define an air gap therebetween. The surface of armature 134 facing the body portion of frame 80 is provided with a region defining a fulcrum point or edge for cooperation with the fulcrum point or edge on the end of magnet 122. In particular, a generally V-shaped groove or recess is defined by surfaces 136 and 138 which meet to define the recess. The inner edge of the recess defined by the juncture of surfaces 136,138 is substantially coincident with the pivot axis of armature 134. The pivot edge defined by surfaces 124,126 on the end of magnet 122 abuts the juncture of the groove surfaces 136,138 as shown in FIG. 1. The angle defined between the armature groove surfaces 136,138 is greater than the angle between the magnet surfaces 124,126 thereby allowing rocking or pivotal movement of armature 134 about the axis. The armature recess is terminated by two end surfaces 140,142 as shown in FIG. 4 which are located within the side edges of armature 134. Thus, the armature recess has a length less than the overall width dimension of armature 134. As a result, when the end of the magnet 122 fits in the armature recess, relative lateral movement between armature 134 and magnet 122 is restricted.

Armature 134 is held in place in the relay by magnetic attraction to the permanent magnet 122 and to one of the pole faces of frame 80 by magnetic flux from magnet 122 flowing in a magnetic circuit including magnet 122, armature 134, the one pole face to which the armature is attracted, the corresponding one of cores 88,90 and the yoke 116. There is provided means for restraining movement of armature 134 in a direction toward header 12 in the form of the armature retaining tabs or formations 98,102 of frame 80 together with a pin 144 received in the notches 100 and 104 of the tabs 98 and 102, respectively, which pin extends across armature 134 in spaced relation thereto. Pin 144 is attached such as by welding to the retention tabs 98,102. Pin 144 does not enter into the operation of the relay but serves solely to prevent the pivot edge of permanent magnet 122 from leaving the confines of the armature recess during shock and vibration. There is a slight clearance between armature 134 and pin 144. The depth of the recess in armature 134 in a direction generally normal to header surface 13 is greater than the spacing between pin 144 and the surface of armature 134 thereby restraining movement of armature of 134 in a direction generally normal to header surface 13.

Armature 134 is provided with means for engaging the movable switch blades or contacts for operating the same in response to pivotal movement of armature 134. As shown in FIG. 1, a first pusher comprises rod 148 secured at one end thereby by a weldment 152 to the surface of armature 134, extending at an angle to the armature surface, and terminating at the opposite end in a bead or enlargement 152 for engaging switch blade 28. Similarly, a second pusher comprises a rod 154 secured at one end by a weldment 156 to the armature surface, disposed at an angle to the armature surface, and terminating in a bead or enlargement 158 for engaging switch blade 38.

The relay structure is assembled in the following manner. After assembly of header 12 is completed, including terminal pins 24, movable contacts 28,38 and fixed contacts 30,32 and 40,42, the coils are placed on cores 88,90 of frame 80, permanent magnet 122 is fixed to yoke 116 which then is fixed to the cores 88,90 as previously described. The end of magnet 122 then extends partly thorugh opening 96 of frame 80 as shown in FIG. 1. Next, the combination of the frame 80, the coils, yoke 116 and magnet 122 is fixed to header 12 by welding legs 82,84 to header 12 as described. Then armature 134 is assembled in position above header 12 and closely adjacent the lower surface of the main body portion of frame 80 with the pivot edge formation on the end of permanent magnet 122 received in the armature groove. The armature 134 is held in position by magnetic attraction to the end of magnet 122 and to one of the frame pole piece sections due to the flow of magnetic flux provided by permanent magnet 122. The permanent magnet 122 may be magnetized as part of the electromagnet subassembly without the header 12 or armature 134 in position for better magnet stability. Also, after magnetization and stabilization, the armature 134 may be put into position and serve as a keeper for subsequent assembly operations.

In the de-energized condition of the relay, the armature 134 is initially magnetically held in position against one of the pole faces, for example the pole face 94 associated with coil 60 as shown in FIG. 1, by the permanent magnet flux. The permanent magnet flux through core 90 and associated portions of yoke 116 and armature 134 is represented by path 164 in FIG. 1. Similarly, the permanent magnet flux associated with core 88 is represented by path 166. At the opposite end of the armature, the pusher 154,158 exerts a force against the movable contact 38 which, in turn, provides a contact force against the lower stationay contact 42 depending on the point of application of the pusher and the compliances of the moveable and stationary contact springs. When electrical power is applied to coil winding 60, a magnetomotive force is generated of sufficient amplitude and proper polarity. This causes a coil flux 170 to be developed which opposes the flux 164 produced by the permanent magnet 122 in the magnetic circuit consisting of the yoke 116, core 90, pole face 94, closed air gap, and closed portion of armature 134 on that side of the electromagnet. At the same time, the coil flux also follows the path 172 existing on the opposite side of the electromagnet associated with coil 50 including the yoke 116, core 88, pole face 92, open air gap, and armature 134. Additionally, the permanent magnet flux follows the path 166 in the same direction of the coil flux 172 thereby producing a total flux which is the sum of the two fluxes.

Hence, the closed gap armature side of the electromagnet has opposing flux paths consisting of permanent magnet flux 164 and coil flux 170 which cancel the effect of each other in the magnetic circuit associated with coil 60. This results in an armature magnetic holding force at this side of the electromagnet of zero or of very low magnitude depending on the absolute value of the two fluxes. The open gap armature side of the electromagnet has aiding flux values produced by the permanent magnet 122 and coil 60 and represented by paths 166 and 172 which effectively produce a significant magnetic pull force at the open gap side of the armature. Additionally, there exists concurrent spring force on the pusher 154,158 at the open air gap end of the armature 134 urging the armature to close the gap which acts in cooperation with the magnetic pull force on the same side.

Therefore, as the closed gap armature force is reduced to approximately zero, and the open gap armature foce rises to a significant pull value acting in concert with the aiding spring forces, the armature 134 is then forced to rotate about the pivot axis in the direction to close the open air gap, i.e. clockwise as viewed in FIG. 1. When the opposing pusher 148,152 associated with the coil 60 electromagnet side comes into contact with the movable contact 28 on that side, its spring force commences to oppose the forces closing the armature gap. However, the armature 134 will have moved closer to the pole face on the coil 50 side and will experience a much higher magnetic force acting to close the gap even further as part of the magnetic force is used to balance out the opposing spring force. The power to the coil 60 can be removed after the armature 134 has rotated slightly more than halfway towards the pole face associated with coil 50 since the permanent magnet flux, although acting alone without the coil flux, will be greater on this side of the magnetic circuit due to the smaller air gap. Inertia due to the armature rotation will assist in continuing the rotary motion in the same direction.

As a result of the foregoing, the moveable contact 38 associated with the coil 50 side will have transferred from its previously closed position on the lower stationary contact 42 to the previously open position on the upper stationary contact 40 thereby closing this contact circuit. The opposing moveable contact 28 associated with the coil 60 side also will have transferred from its previously closed position on the upper stationary contact 30 to the previously open position on the lower stationary contact 32 thereby closing this contact.

By proceeding through a similar analysis, it will be apparent that energizing coil 50 after the above cycle is completed will operate the armature 134 causing it to reverse the rotation, as described in the previous sequence of events, in a similar fashion and returning the contacts 28,38 to their previous positions.

The non-magnetic portion 108 of the frame 80 is of prime importance in the foregoing operation because it provides a high reluctance barrier in the frame to the permanent magnet flux 164,166 and coil flux 170,172 flowing through magnet 122. It forces these fluxes to follow the lower reluctance path perpendicular to the end of the permanent magnet and the surface of the armature 134 in the area adjacent to and on the pivot point. In effect, the non-magnetic portion 108 of the frame 80 functions as an air gap of high reluctance between the pole faces of the two coil structures of the electromagnet. Without this effective air gap, the fluxes from the permanent magnet 122 and coils 50,60 would be shunted through the frame 80 and thus bypass the armature which would be undesirable. It is not essential that the supporting members 82,84 be constructed of non-magnetic material because the pole faces 92,94 are at the same mmf potential preventing any leakage flux paths to occur. In addition to the role of barrier 108 forcing the magnetic fluxes to follow the lower reluctance path perpendicular to the end of the permanent magnet 122 and the armature surface in the area adjacent to and on the pivot point, the shape of the end of magnet 122 contributes to increased coupling of magnetic flux to armature 134. This results from the provision of surfaces 128, 130 adjacent the pivot edge formation which surfaces 128,130 are substantially parallel to and closely spaced from the armature surfaces adjacent the groove.

The single, one-piece frame 80 provides cores, pole faces, supporting legs and armature retention tabs thereby simplifying the structure and assembly of the relay. The main body portion of frame 80 may be viewed as an intermediate shelf or bridge with the yoke 116 supported in spaced relation to it by cores 88,90 extending from the shelf or bridge and the yoke, in turn, supporting permanent magnet 122 which depends therefrom and extends through the opening 96 in the main body portion. The relatively short length of supporting legs 82,84 raises the resonant frequency of the relay structure thereby providing desirable shock and vibration characteristics. Also, since frame 80 provides all the support and positioning, it is not affected by variations in the dimensions of the coil bobbins which can vary significantly due to tolerances and differences in coil winding pressure.

The armature retention tabs 98,102 and pin 144 do not enter into operation of the relay but serve solely to prevent the pivot edge formation on magnet 122 from moving away from the confines of the armature groove during shock and vibration. This is because the gap or spacing between pin 144 and the surface of armature 134 is less than the depth of the armature groove. Also, relative lateral movement between armature 134 and magnet 122 is restricted by virtue of the armature groove having a length less than the width of the armature.

Figure 5:
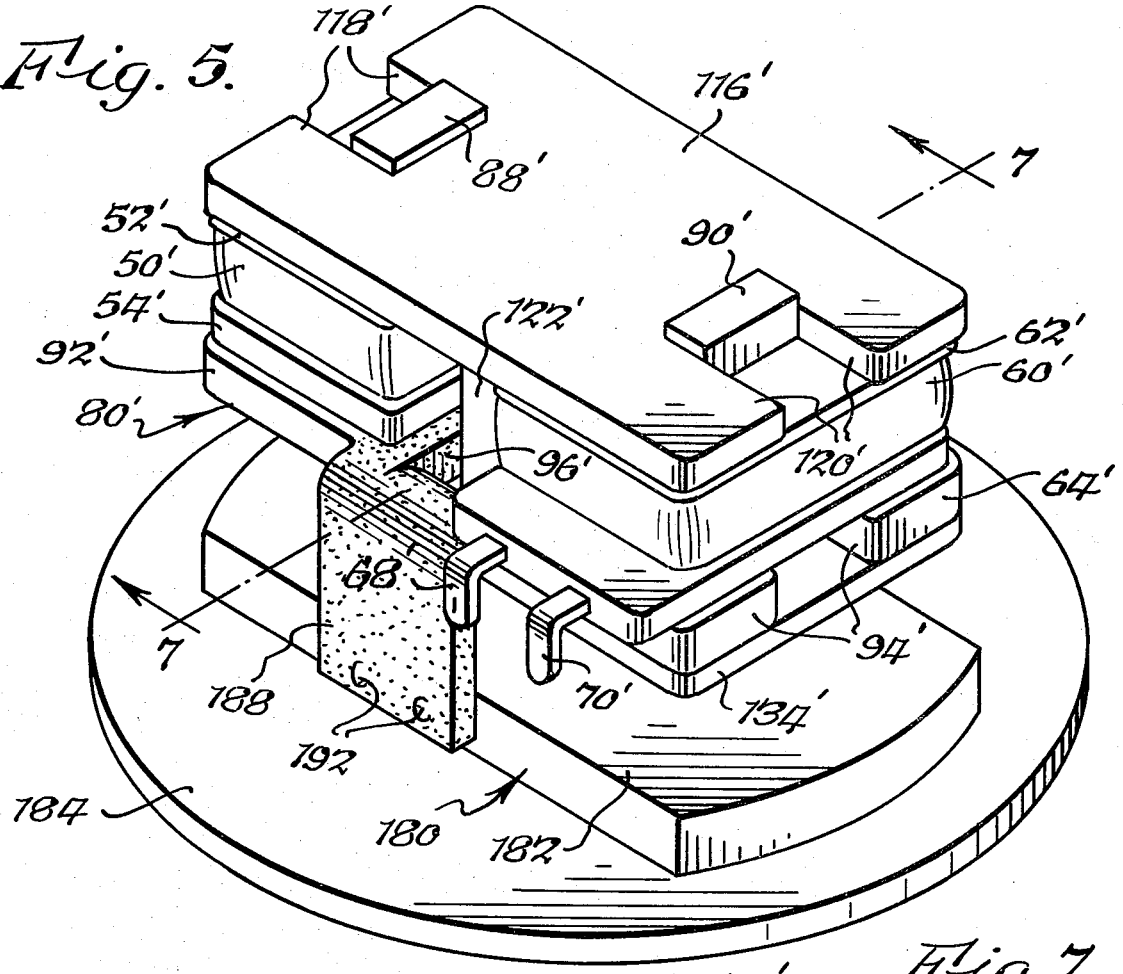
FIG. 5 is a perspective view with parts removed of a miniature magnetic latch relay including a frame according to another embodiment of the present invention.
Figure 7:
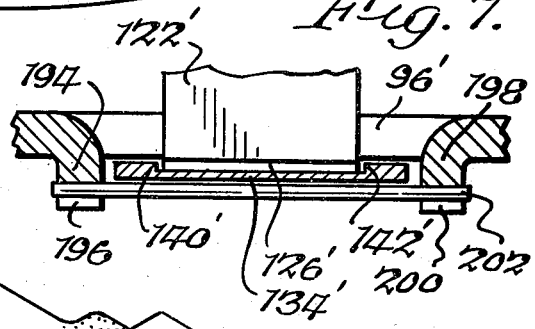
FIG. 7 is a fragmentary sectional view taken along lines 7—7 in FIG. 5.
Figure 6:
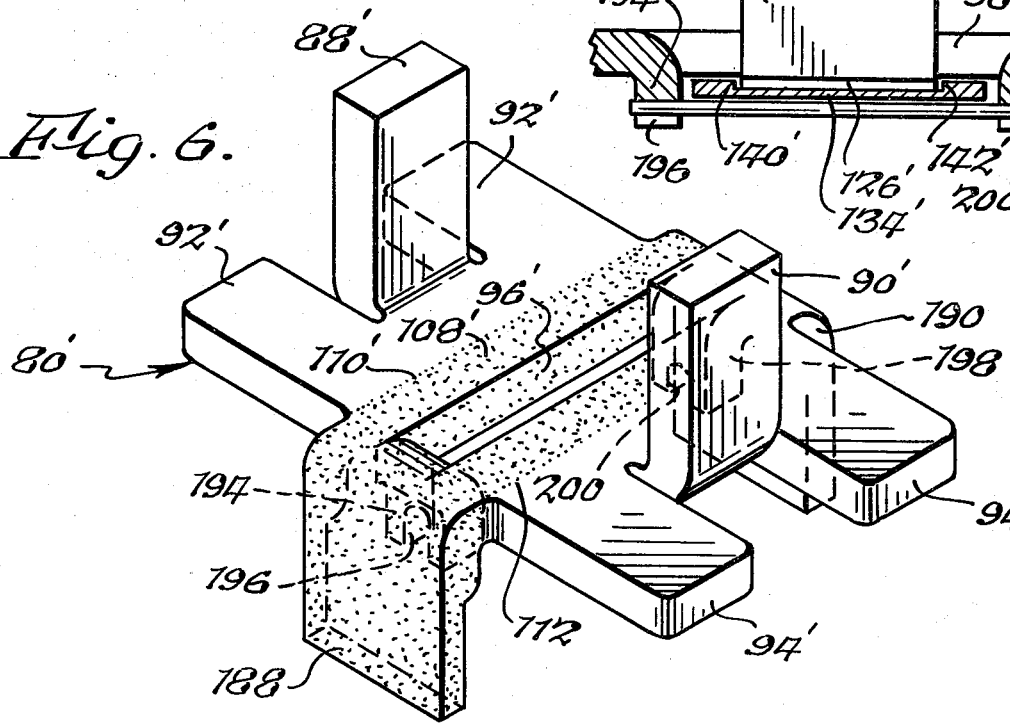
FIG. 6 is a perspective view of the frame included in the relay of FIG. 5.

FIGS. 5–7 illustrate a miniature magnetic latch relay according to another embodiment of the present invention. In FIGS. 5–7 components identical to those shown in FIGS. 1–4 are identified by similar reference numerals having a prime designation. A header 180 is of generally rectangular shape but provided with curved ends and includes a platform surface 182. An arrangement of terminal pins and fixed and movable contacts (not shown) identical to that of the relay of FIGS. 1–4 is carried by header 180. A pair of supporting legs 188,190 extend from corresponding side edges of the main body portion of frame 80' in substantial alignment about midway between the ends of the frame body portion. Legs 188,190 are fixed to header 180 such as by welds 192. In this embodiment, legs 188,190 are of the same non-magnetic material as barrier region 108' of frame 80' merely for convenience in fabrication. In other words, having supporting legs 188,190 of non-magnetic material is not essential for proper operation of the relay of this embodiment. Because of the location of supporting legs 188,190 the armature retention tabs extend inwardly from the side edges of the frame body portion. Thus tab 194 extends inwardly from the side edge containing leg 188 and is provided with a notch 196. Similarly, tab 198 extends inwardly from the frame side edge containing leg 190 and is provided with a notch 200. A pin 202 is received and fixed in tabs 194,198 and spaced from armature 134' in a manner identical to that of pin 144 in the relay structure of FIGS. 1–4.

Figure 8:
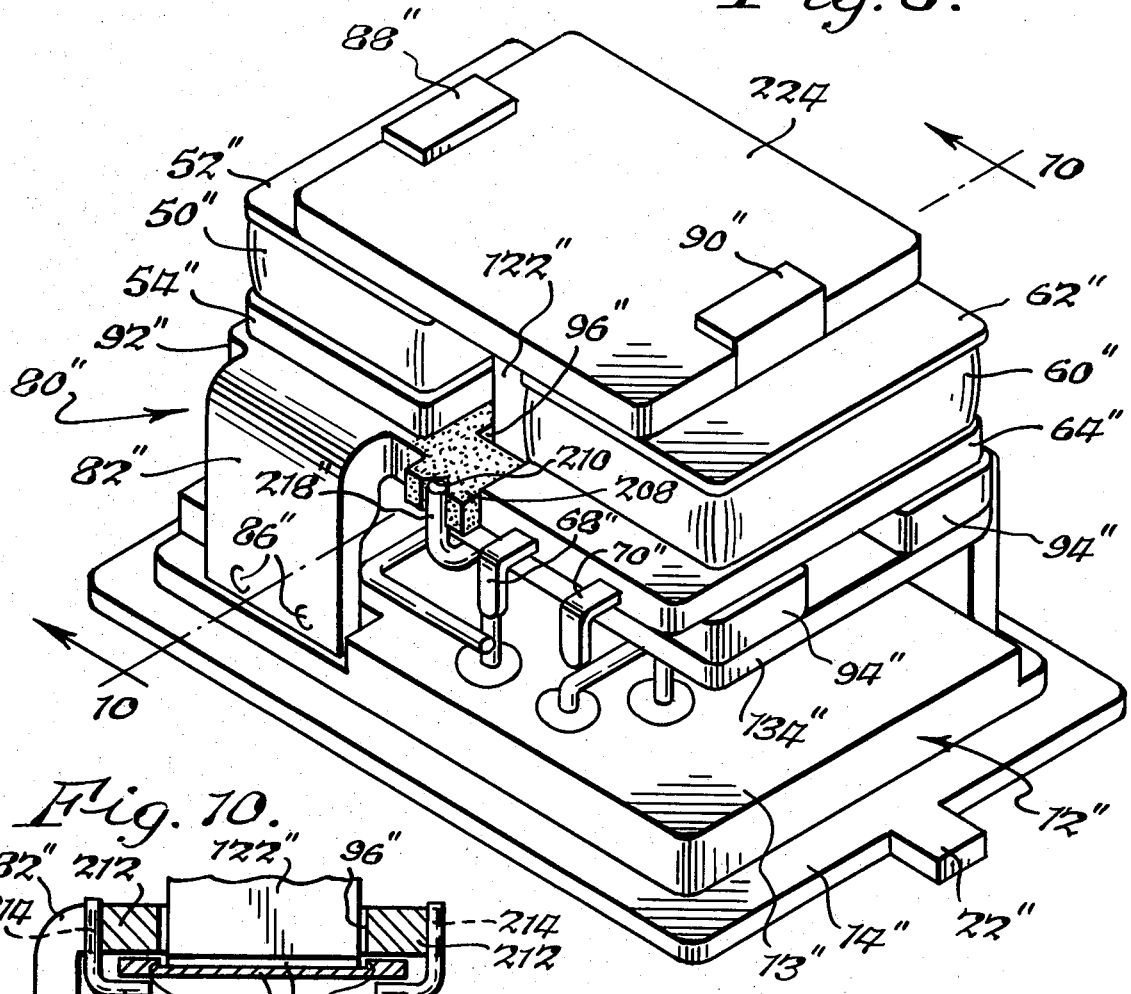
FIG. 8 is a perspective view with parts removed of a miniature magnetic latch relay including a frame according to another embodiment of the present invention.
Figure 10:
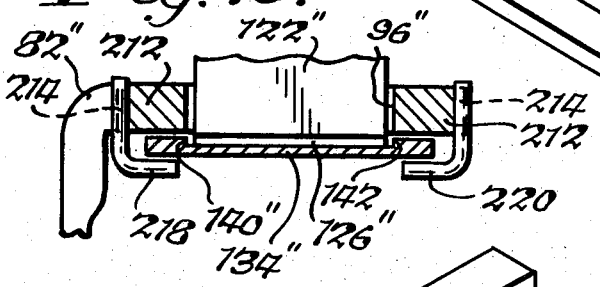
FIG. 10 is a fragmentary sectional view taken along lines 10—10 in FIG. 8.
Figure 9:
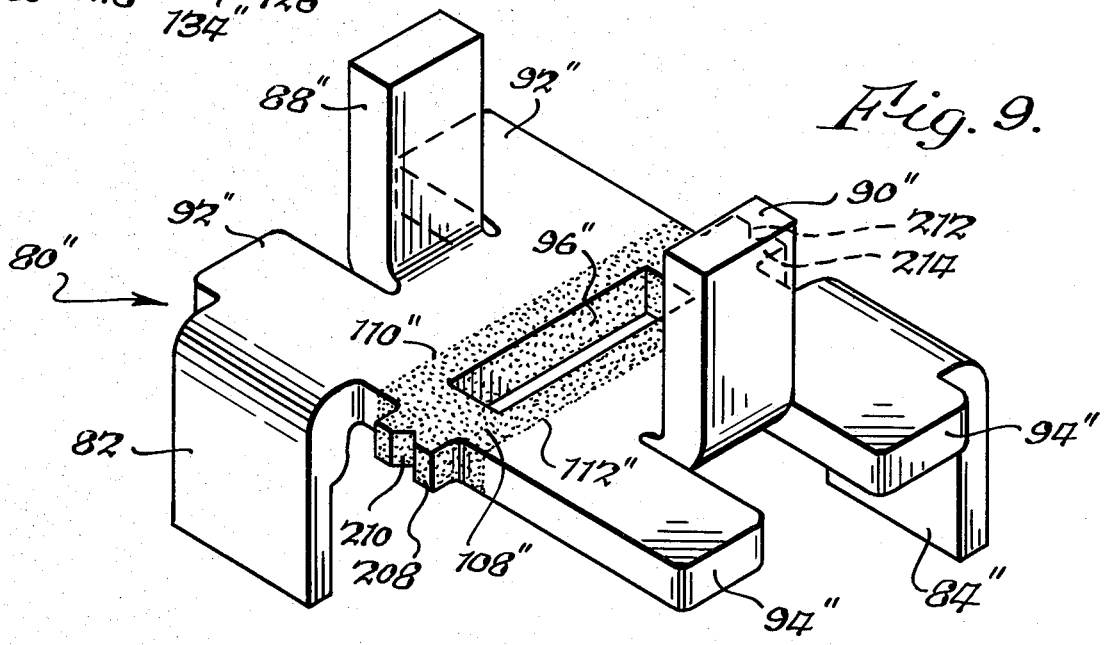
FIG. 9 is a perspective view of the frame included in the relay of FIG. 8.

FIGS. 8–10 illustrate a miniature magnetic latch relay according to another embodiment of the present invention. In FIGS. 8–10 components identical to those shown in FIGS. 1–4 are identified by similar reference numerals having a double prime designation. In this embodiment the armature retention tabs are in the same plane as the frame main body portion and two pins each extending along a portion of the armature are employed. Thus, an armature retention tab 208 extends outwardly from the side edge of frame 80'' including leg 82'', is located about mid-way between the ends of the frame, and is provided with a notch 210 in the outer edge surface thereof. Similarly, an armature retention tab 212 extends outwardly from the other side edge of frame 80'' including leg 84'', is located about mid-way between the ends of the frame, and is provided with a notch 214 in the outer edge surface thereof. The tabs 208,212 are of the same non-magnetic material as barrier region 108'' of frame 80'' merely for convenience in fabrication. A first generally L-shaped pin 218 has one leg fixed as by welding in notch 210 of tab 208 and has the other leg extending in spaced relation to armature 134''. A second generally L-shaped pin 220 has one leg fixed as by welding in notch 214 of tab 212 and the other leg extending in spaced relation to armature 134''. The spacing between the leg of each pin 218,220 and the surface of armature 134'' is less than the depth of the armature groove as in the relay structure of FIGS. 1–7. Also, in this relay structure a yoke 224 of slightly smaller length is employed.

From the foregoing description of the structure and operation of the illustrated embodiments of this invention, it is apparent that an improved miniature magnetic latch relay of simplified construction has been provided. The miniature relay of this invention is of low cost employing a single, one-piece frame which provides cores, pole faces, supporting legs and armature retention tabs for simplified assembly thereby to minimize assembly cost while at the same time providing improved relay operation. The barrier of non-magnetic material associated with the opening in the frame which receives the permanent magnet insures that all the magnetic flux flows between the permanent magnet and armature for increased relay operating efficiency. The shape of the pivot edge formation on the end of the permanent magnet which pivotally contacts the armature increases the coupling of magnetic flux between the permanent magnet and armature thereby contributing to increased operating efficiency. The provision of the armature retention tab and pin arrangement, with the pin to armature surface spacing being less than the depth of the armature groove in which the permanent magnet edge is received, insures that the armature remains trapped under vibratory and shock load conditions for increased reliability. Having the armature groove extend along a distance less than the armature width restricts relative lateral movement between the armature and permanent magnet also contributing to increased reliability.

As will be apparent to persons skilled in the art, various modifications and adaptations of the structure above described will become readily apparent without departure from the spirit and scope of the invention the scope of which is defined in the appended claims.

I claim:

1. In a miniature magnetic latch relay including a support header, a permanent magnet, and an armature in pivotal contact with said magnet for movement between two stable positions in response to selective energization of two electromagnetic coils, the improvement comprising:

a frame having a main body portion spaced from said header and in close relation to said armature, a pair of spaced-apart pole piece sections of magnetic material in said main body portion and operatively associated with said armature, a pair of spaced-apart supporting legs extending from said main body portion toward said header and fixed to said header, a pair of core sections of magnetic material extending from said main body portion in a direction away from said header through said coils and into magnetic and mechanical coupling relation with said permanent magnet, an opening in said main body portion through which a portion of said permanent magnet extends for said pivotal contact with said armature, and a barrier in said body portion between said opening and said core and pole piece sections of a material having sufficient reluctance to resist the flow of magnetic flux between said permanent magnet and said main body magnet and said armature.

2. The miniature relay recited in claim 1, wherein said barrier surrounds said opening.

3. The miniature relay recited in claims 1 or 2, wherein said barrier is of non-magnetic material.

4. The miniature relay recited in claims 1 or 2, wherein said frame is of iron and said barrier is of stainless steel.

5. The miniature relay recited in claim 1, wherein said main body portion of said frame has said pole piece sections at opposite ends and has a pair of side edges extending between said ends and wherein said supporting legs extend from corresponding ones of said side edges in offset relation with each leg being near a corresponding one of said ends.

6. The miniature relay recited in claim 1, wherein said main body portion of said frame has said pole piece sections at opposite ends and has a pair of side edges extending between said ends and wherein said supporting legs extend from corresponding ones of said side edges in substantial alignment about mid-way between said ends.

7. The miniature relay recited in claim 1, further including a yoke of magnetic material disposed substantially parallel to said frame main body portion and fixed to said cores in a manner such that said coils are located between said yoke and said frame main body portion, said permanent magnet being fixed to said yoke.

8. The miniature relay recited in claim 1, wherein said main body portion of said frame has said pole piece sections at opposite ends thereof and has said core sections adjacent corresponding ones of said pole piece sections, said opening being located generally centrally in said frame main body portion relative to said pole piece sections and said core sections.

9. The miniature relay recited in claim 1, wherein said main body portion of said frame has said pole piece sections at opposite ends thereof and has a longitudinal axis extending between said ends, and wherein said opening is elongated and has a longitudinal axis disposed substantially perpendicular to said longitudinal axis of said main body portion.

10. In a miniature magnetic latch relay including a support header, a permanent magnet having a pivot edge formation on one end, and an armature having a groove in one surface thereof and in pivotal contact with said magnet by said pivot edge formation of said magnet being received in said armature groove for movement of said armature about a pivot axis extending along said groove between two stable positions in response to selective energization of two electromagnetic coils, the improvement comprising:

a frame having a main body portion spaced from said header and in close relation to the surface of said armature facing away from said header, a pair of spaced-apart pole piece sections of magnetic material in said main body portion and operatively associated with said armature, a pair of spaced-apart supporting legs extending from said main body portion toward said header and fixed to said header, a pair of core sections of magnetic material extending from said main body portion in a direction away from said header through said coils and into mechanical and magnetic coupling relation with said permanent magnet, an opening in said main body portion through which said end of said permanent magnet extends for said pivotal contact with said armature, and armature retention means carried by said main body portion and extending in closely spaced relation to the surface of said armature facing said header for retaining said pivot edge formation of said permanent magnet in said armature groove under vibratory and shock load conditions encountered by said relay, the spacing between said armature retention means and said armature surface being less than the depth of said armature groove.

11. The miniature relay recited in claim 10, wherein said main body portion of said frame has said pole piece sections at opposite ends and has a pair of side edges extending between said ends, and wherein said armature retention means comprises a pair of formations each extending from a corresponding one of said side edges of said frame main body portion and pin means fixed to said formations and extending in spaced relation to the surface of said armature which faces said header, the distance between said pin means and said armature surface being less than the depth of said armature groove.

12. The miniature relay recited in claim 11, wherein said pin means comprises a single pin fixed at opposite ends to said formations and extending across the entire width of said armature.

13. The miniature relay recited in claim 11, wherein said pin means comprises a pair of pins, each being fixed at one end to a corresponding one of said formations and each extending inwardly across said armature a distance less than the width of said armature.

14. The miniature relay recited in claim 10, wherein the length of said armature groove is less than the width of said armature thereby restraining relative lateral movement between said armature and said permanent magnet.

15. The miniature relay recited in claim 10, wherein said armature groove is substantially V-shaped, said permanent magnet has a longitudinal axis substantially perpendicular to said armature pivot axis, and wherein said formation on said end of said permanent magnet comprises a pair of surfaces disposed at acute angles to said magnet longitudinal axis and meeting to define said pivot edge, said surfaces being movably received in said armature groove, and said surfaces meeting a corresponding pair of surfaces extending outwardly therefrom in a direction substantially perpendicular to said magnet longitudinal axis and substantially parallel to the surface of said armature adjacent said groove.

16. The miniature relay recited in claim 10, wherein said permanent magnet has a longitudinal axis disposed substantially perpendicular to said main body portion of said frame and further including a yoke of magnetic material disposed substantially parallel to said frame main body portion and fixed to said core sections, said permanent magnet being fixed at the other end thereof to said yoke.

17. The miniature relay recited in claim 10, further including a barrier in said main body portion of said frame between said opening and said core and pole piece sections of a material having sufficient reluctance to resist the flow of magnetic flux between said permanent magnet and said frame main body portion thereby forcing magnetic flux to flow between said permanent magnet and said armature.

18. A miniature magnetic latch relay comprising:

(a) a support header having a plurality of terminal pins extending therethrough;

(b) at least one pair of fixed contacts carried by said header and electrically coupled to corresponding ones of said pins;

(c) a movable contact carried by said header electrically coupled to another one of said pins, normally engaging one of said fixed contacts and adapted to be moved into engagement with the other of said fixed contacts;

(d) a frame having a main body portion spaced from said header, a pair of spaced-apart pole piece sections of magnetic material in said main body portion, a pair of spaced-apart supporting legs extending from said main body portion toward said header and fixed to said header, a pair of core sections of magnetic material extending from said main body portion in a direction away from said header, and an opening in said main body portion;

(e) an electromagnet assembly comprising a pair of coils located on said core sections so as to be carried by said frame;

(f) a permanent magnet assembly comprising a yoke of magnetic material disposed substantially parallel to said main body portion of said frame and fixed to said cores in a manner such that said coils are between said yoke and said frame main body portion, and an elongated permanent magnet having a longitudinal axis disposed substantially perpendicular to said main body portion of said frame, said permanent magnet being fixed at one end to said yoke and extending at the other end thereof through said opening in said main body portion of said frame;

(g) an armature of magnetic material located between said header and said frame in close relation to said main body portion of said frame and having a portion in operative engagement with said movable contact, said armature being in pivotal contact with said other end of said permanent magnet for movement between two stable positions in contact with either of said pole piece sections of said frame main body portion about an axis substantially perpendicular to said longitudinal axis of said permanent magnet; and (h) a barrier in said main body portion of said frame between said opening and said core and pole piece sections of a material having sufficient reluctance to resist the flow of magnetic flux between said permanent magnet and said main body portion of said frame thereby forcing magnetic flux flow between said permanent magnet and said armature;

(i) whereby said armature is held in either of said two stable positions in contact with one of said pole piece sections by flux from said permanent magnet thereby placing said movable contact in engagement with one of said fixed contacts and is moved to the other of said stable states by selective energization of said coils thereby placing said movable contact in engagement with the other of said fixed contacts.

19. The miniature relay recited in claim 18, wherein said barrier surrounds said opening in said main body portion of said frame.

20. The miniature relay recited in claims 18 or 19, wherein said barrier is of non-magnetic material.

21. The miniature relay recited in claim 18, wherein said permanent magnet has a pivot edge formation on said one end thereof and said armature has a groove in the surface thereof for receiving said formation to provide said pivotal contact between said magnet and said armature, and further including armature retention means carried by said main body portion of said frame and extending in closely spaced relation to the surface of said armature facing said header for retaining said pivot edge formation of said permanent magnet in said armature groove under vibratory and shock load conditions encountered by said relay, the spacing between said armature retention means and said armature surface being less than the depth of said armature groove.

22. The miniature relay recited in claim 21, wherein said main body portion of said frame has said pole piece sections at opposite ends and has a pair of side edges extending between said ends and wherein said armature retention means comprises a pair of formations, each extending from a corresponding one of said side edges of said frame main body portion, and pin means fixed to said formations and extending in spaced relation to the surface of said armature which faces said header, the distance between said pin means and said armature surface being less than the depth of said groove.

23. The miniature relay recited in claim 22, wherein said pin means comprises a single pin fixed at opposite ends to said formations and extending across the entire width of said armature.

24. The miniature relay recited in claim 22, wherein said pin means comprises a pair of pins, each being fixed at one end to a corresponding one of said formations and each extending inwardly across said armature a distance less than the width of said armature.

25. The miniature relay recited in claim 18, wherein the length of said armature groove is less than the width of said armature thereby restraining relative lateral movement between said armature and said permanent magnet.

26. The miniature relay recited in claim 18, wherein said armature groove is substantially V-shaped and wherein said formation on said end of said permanent magnet comprises a pair of surfaces disposed at acute angles to said magnet longitudinal axis and meeting to define said pivot edge, said surfaces being movably received in said armature groove, said surfaces meeting a corresponding pair of surfaces extending outwardly therefrom in a direction substantially perpendicular to said magnet longitudinal axis and substantially parallel to the surface of said armature adjacent said groove.

* * * * *

UNITED STATES PATENT AND TRADEMARK OFFICE

CERTIFICATE OF CORRECTION

PATENT NO. : 4,366,459

DATED : December 28, 1982

INVENTOR(S) : Vitola, Jack J.

It is certified that error appears in the above—identified patent and that said Letters Patent is hereby corrected as shown below:

Column 4, line 38 wherein the word "as" should be --has--.

Column 5, line 26 wherein "24a" should be --24i--.

Column 6, line 20 wherein the words "pole section sections" should be --pole piece sections--.

Column 7, line 4 wherein the word "surface" should be --surfaces--.

Column 8, line 10 wherein the word "thereby" should be --thereof--.

Column 8, line 55 wherein the word "stationay" should be --stationary--.

Column 9, line 17 wherein the word "exists" should be --exists a--.

Column 10, line 30 wherein the words "through the" should be --through--.

Signed and Sealed this

Twenty-ninth Day of March 1983

[SEAL]

Attest:

GERALD J. MOSSINGHOFF

Attesting Officer

Commissioner of Patents and Trademarks